US006530818B1

(12) United States Patent
Stuntz et al.

(10) Patent No.: US 6,530,818 B1
(45) Date of Patent: Mar. 11, 2003

(54) AUDIO DEVICE HAVING THE APPEARANCE OF AN ANIMAL

(75) Inventors: Sara Stuntz, Delaware, OH (US); Stephanie Yeager, Westerville, OH (US)

(73) Assignee: Madicleo Limited, Delaware, OH (US)

( * ) Notice: Subject to any disclaimer, the term of this patent is extended or adjusted under 35 U.S.C. 154(b) by 0 days.

(21) Appl. No.: 09/964,067

(22) Filed: Sep. 25, 2001

Related U.S. Application Data

(60) Provisional application No. 60/242,777, filed on Oct. 24, 2000.

(51) Int. Cl.[7] ..... A63H 03/28

(52) U.S. Cl. ..... 446/297; 446/298; 381/305

(58) Field of Search ..... 446/297, 408, 446/175, 298–99, 308, 317, 319, 330, 337, 376, 392, 397, 486, 491; 381/303–305; D14/189, 164, 168; D21/113

(56) References Cited

U.S. PATENT DOCUMENTS

| | | | | | |
|---|---|---|---|---|---|
| 4,015,327 | A | | 4/1977 | McCarthy | 29/460 |
| D253,311 | S | | 10/1979 | Ming | D14/6 |
| 4,388,492 | A | * | 6/1983 | Masaaki | 179/1 GA |
| 4,450,495 | A | * | 5/1984 | Toshimasa | 360/137 |
| 4,521,205 | A | | 6/1985 | Spector | 446/302 |
| 4,579,540 | A | | 4/1986 | Ho | 446/301 |
| D288,219 | S | | 2/1987 | Bedell et al. | D21/113 |
| 4,642,710 | A | | 2/1987 | Murtha et al. | 360/79 |
| 4,965,855 | A | | 10/1990 | Tsuji | 455/344 |
| D315,735 | S | | 3/1991 | Chu | D14/189 |
| D346,600 | S | | 5/1994 | Grasso | D14/189 |
| D369,165 | S | | 4/1996 | Mattikow | D14/164 |
| D377,017 | S | | 12/1996 | Giumarra | D14/164 |
| 5,984,758 | A | * | 11/1999 | Driska et al. | 446/143 |
| 6,005,642 | A | * | 12/1999 | Meisner et al. | 348/838 |
| D451,492 | S | * | 12/2001 | Stuntz et al. | D14/168 |

* cited by examiner

*Primary Examiner*—Derris H. Banks
*Assistant Examiner*—Jamila Williams
(74) *Attorney, Agent, or Firm*—Standley & Gilcrest LLP

(57) ABSTRACT

The present invention includes an audio device that has the appearance of an animial. The audio set may contain a radio, compact disc player and/or cassette player. Also included in the present invention is a audio device in which the speakers are made to resemble the eyes of an animal and the speakers are fixably or moveably secured. The speakers may pop-out from the face of the animal on springs or the speakers may rotate. Finally, the present invention includes an audio device in which the speakers are made to resemble the eyes of an animal, are moveably secured and are actuated by a switch on the audio device.

7 Claims, 4 Drawing Sheets

AUDIO DEVICE HAVING THE APPEARANCE OF AN ANIMAL

This application claims the priority of U.S. Provisional Application Ser. No. 60/242,777, filed Oct. 24, 2000.

TECHNICAL FIELD OF THE INVENTION

The present invention relates to an audio device having the appearance of an animal. The audio device may include a radio, and/or a compact disc player and/or cassette tape player.

BACKGROUND AND SUMMARY OF THE INVENTION

The present invention includes an audio device that has the appearance of an animal. The audio device may contain a radio, and/or a compact disc player, and/or a cassette player.

The present invention includes an audio device in which the speakers are made to resemble the eyes of an animal. The audio device may contain a radio, and/or a compact disc player, and/or a cassette player.

Also included in the present invention is a audio device in which the speakers are made to resemble the eyes of an animal and the speakers are fixably or moveably secured. The speakers may pop-out from the face of the animal on springs or the eyes may rotate. The audio device may contain a radio, and/or a compact disc player, and/or a cassette player.

Finally, the present invention includes an audio device in which the speakers are made to resemble the eyes of an animal, are moveably secured and are actuated by a switch on the audio device. The audio device may contain a radio, and/or a compact disc player, and/or a cassette player.

DETAILED DESCRIPTION OF THE PREFERRED EMBODIMENT(S)

Figure 1:
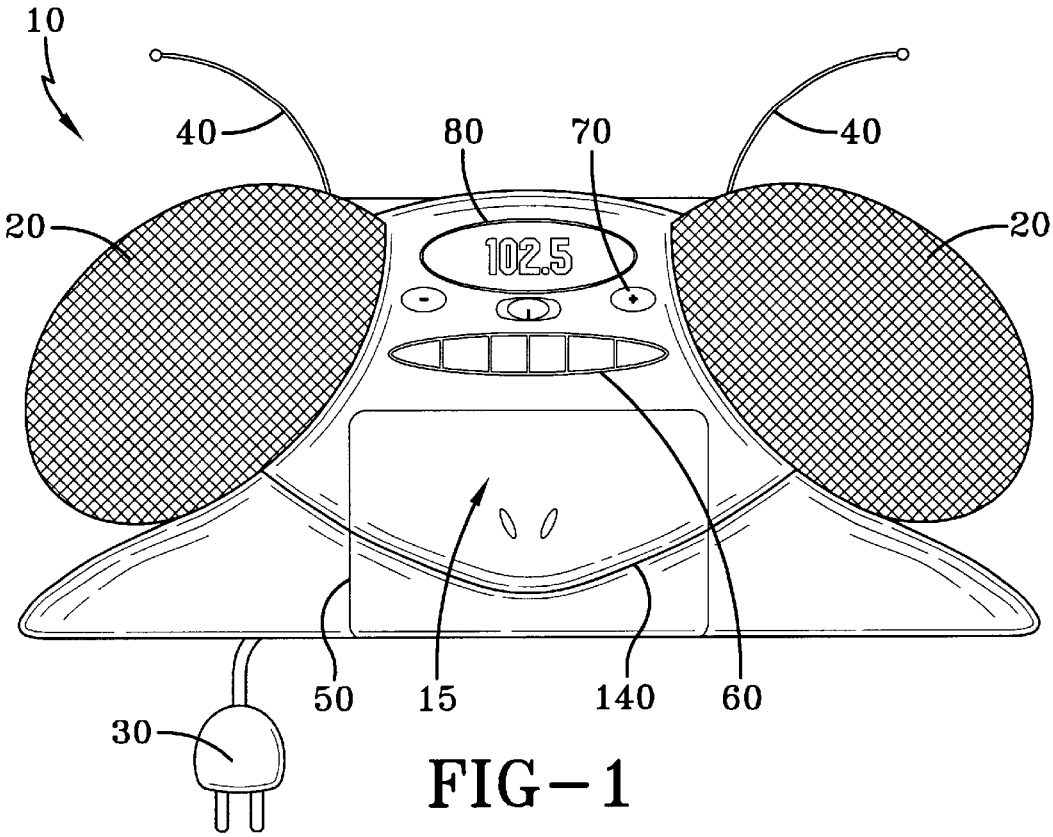
FIG. 1 is a front view of an audio set made to resemble an animal, in accordance with the invention.

Referring to FIG. 1, there is shown the front view of a preferred embodiment of an audio device 10 according to this invention, in which the audio device 10 includes: a sound 15 generator; speakers 20; an actuation switch; and a power supply 30, wherein the audio device 10 has the appearance of an animal, and wherein the speakers 20 comprise a set of eyes of the animal.

The antenna 40 of the animal may be the antenna 40 of the audio device. The cassette tape module 50 may be located in the lower portion to resemble the mouth of the animal. The switches to operate the cassette player 60 may be located above the opening for receiving the tape. The switches to operate a radio 70 may be located on below and on either side of the radio channel display window 80.

Figure 2:
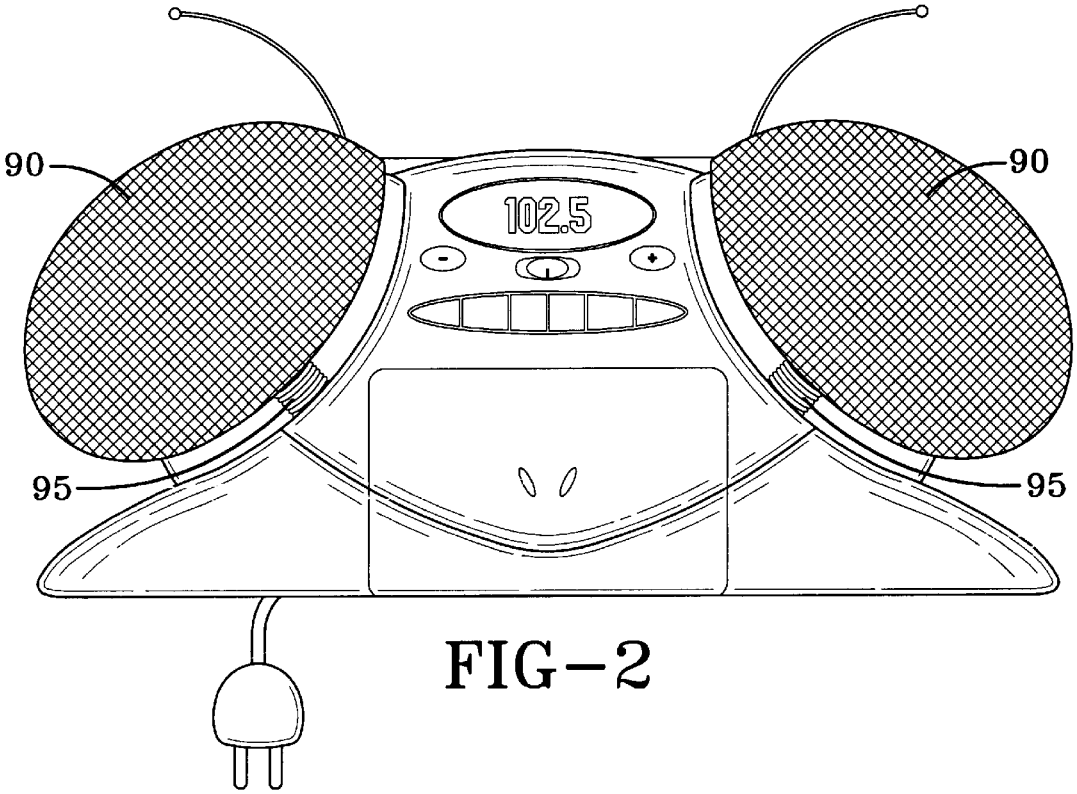
FIG. 2 is a front view of an audio set made to resemble an animal showing the moveably secured speakers popping-out on springs, in accordance with the invention.

Referring to FIG. 2, there is shown the front view of a preferred embodiment of an audio device according to the invention, in which the speakers 90 are shown as they pop-out on springs 95. The springs may be acutated by a switch on the audio device and may pop-out about 1 inch. The speakers 90 on springs 95 may be manually pushed back to engage a device to hold them in place.

Figure 3:
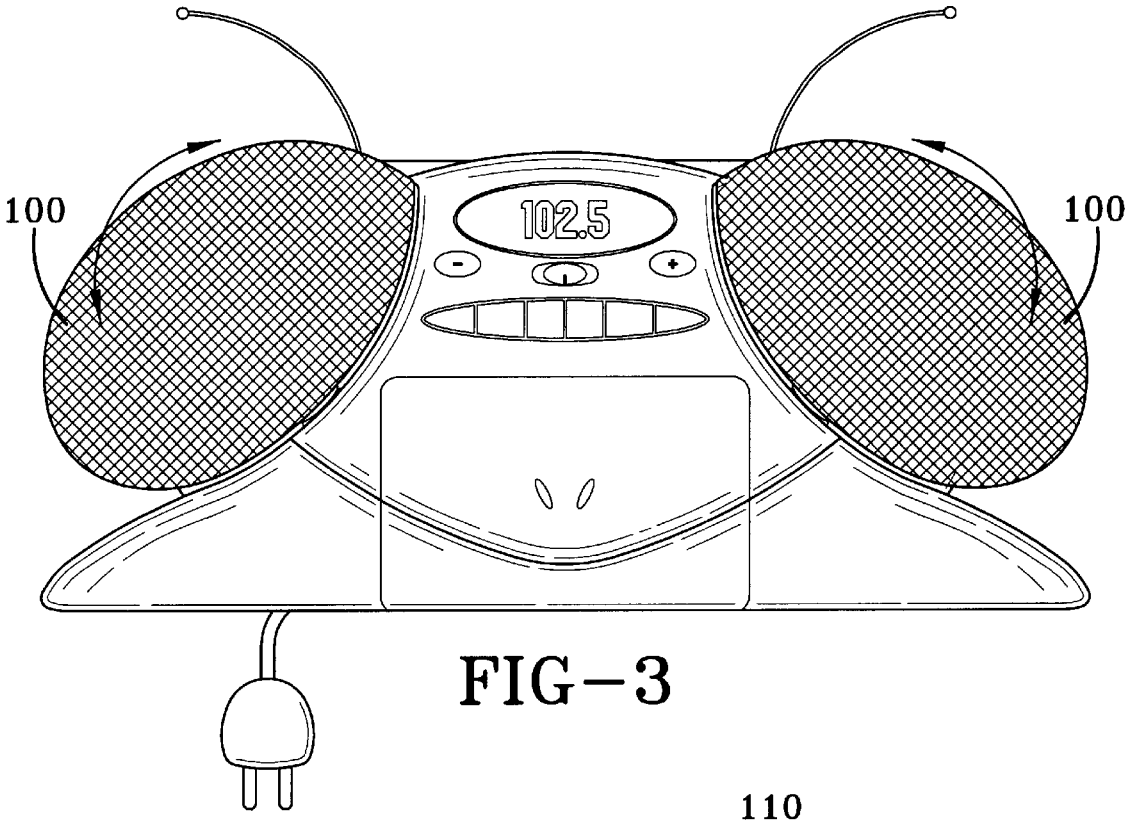
FIG. 3 is a front view of an audio set made to resemble an animal showing the moveably secured speakers rotating, in accordance with the invention.

Referring to FIG. 3, there is shown the front view of a preferred embodiment of an audio device according to the invention, in which the speakers 100 are shown to rotate a limited number of degrees or may fully rotate 360°.

Figure 4:
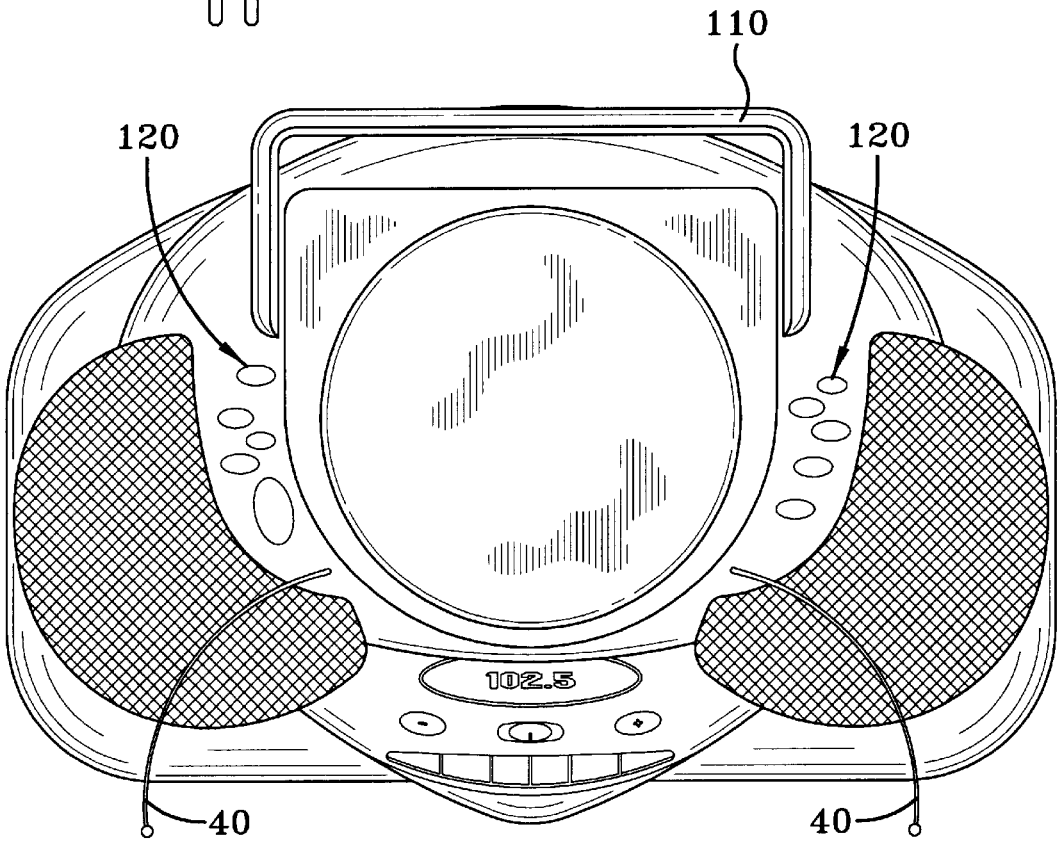
FIG. 4 is a top view of an audio set made to resemble an animal, in accordance with the invention.

Referring to FIG. 4, there is shown the top view of a preferred embodiment of an audio device according to the invention. Shown is the handle 110 for carrying the audio device, the antenna 40, and various switches 120 for such functions as opening the compact disc player, turning off or on the audio device, fast forwarding, rewinding, pausing, stopping, tuning the radio frequency, and acutating the speakers to pop-out or rotate.

Figure 5:
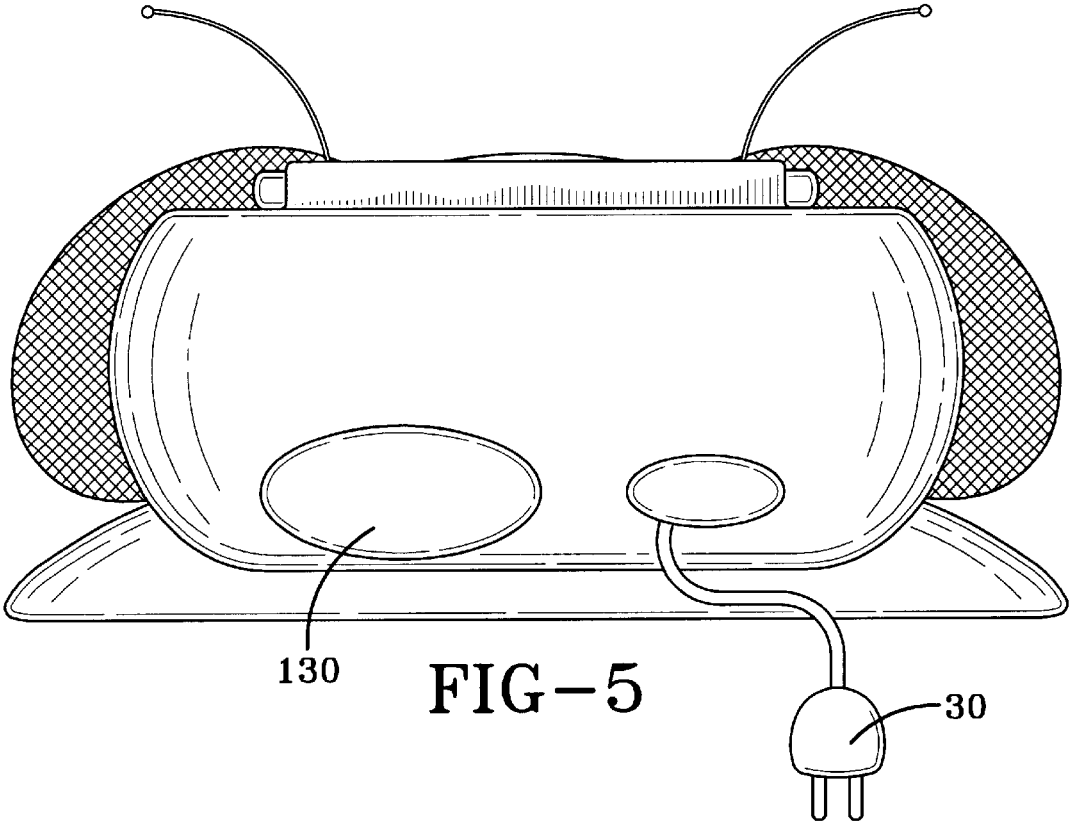
FIG. 5 is a rear view of an audio set made to resemble an animal, in accordance with the invention.

Referring to FIG. 5, there is shown the rear view of a preferred embodiment of an audio device according to the invention, in which a dc power supply is shown. A battery cavity 130 with a cover member is additionally exemplified as an alternative power source.

Figure 6:
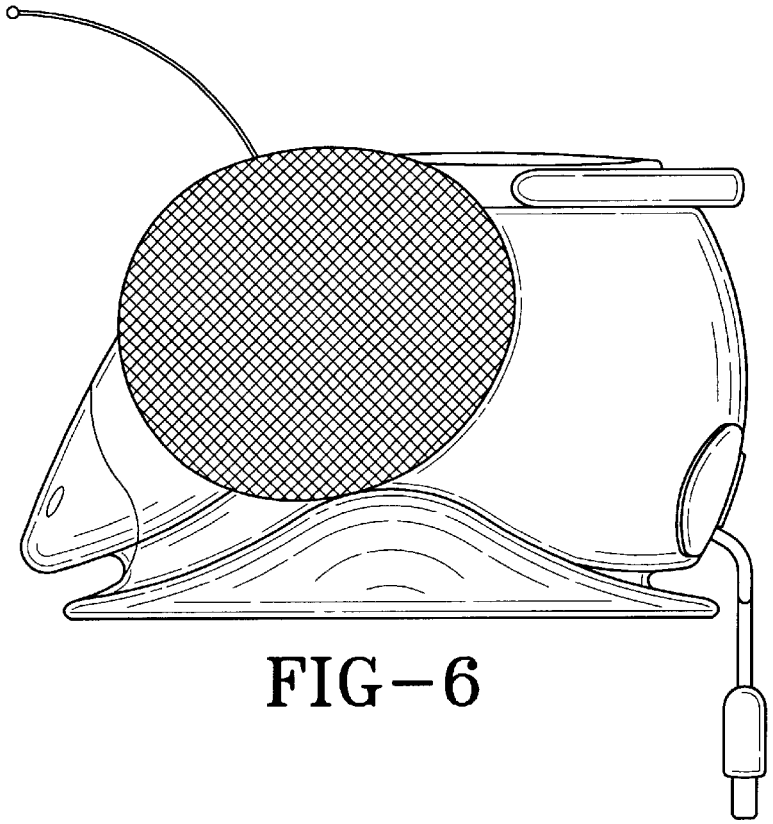
FIG. 6 is a side view of an audio set made to resemble an animal, in accordance with the invention.

Referring to FIG. 6, there is shown the side view of a preferred embodiment of an audio device according to the invention.

Figure 7:
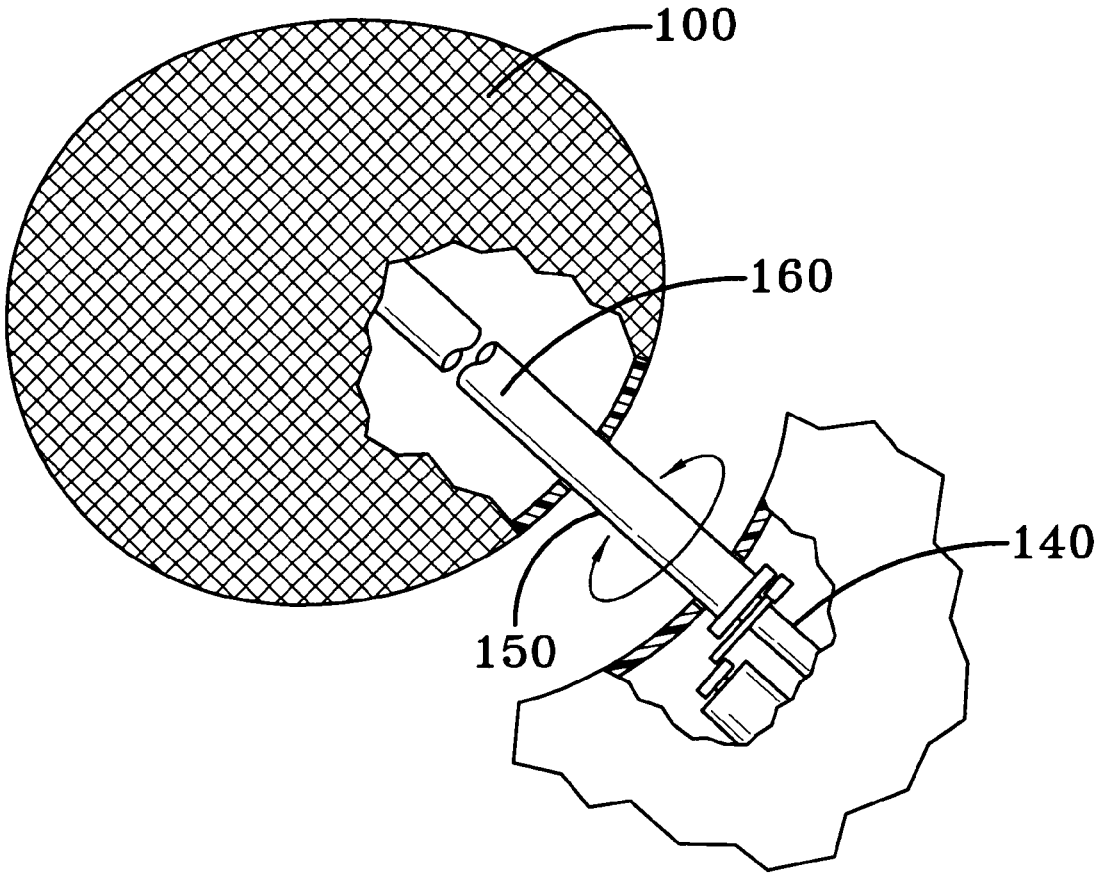
FIG. 7 is a cut-away view of a speaker showing the rotation mechanism for a moveably secured speaker that rotates.

Referring to FIG. 7, there is shown a cut-away view of a speaker 100 showing the rotation mechanism for a moveably secured speaker that rotates. A motor 140 provides the power to move a mechinism which then rotates the post 150 attached to the speaker. The speakers may rotate a limited number of degrees or may fully rotate 360°. The speaker wire 160 is in the center of the post and the post can be made of metal or plastic. The motor is acutated by a switch on the audio device.

While there has been shown and described a preferred embodiment of an audio device having the appearance of an animal in accordance with the invention, it will be appreciated that many changes and modifications may be made therein without, however, departing from the essential spirit thereof. Therefore, it is intended that the specification and drawings be interpreted as illustrative.

What is claimed is:

1. An audio device comprising:

a) a sound generator having a face;

b) two speakers in the general shape of animal eyes, said speakers mounted to said sound generator at two locations on said face of said sound generator;

c) an actuation switch associated with said sound generator; and d) a power supply adapted to provide electrical power to said sound generator, wherein said speakers pop-out on a spring mount from said sound generator.

2. An audio device comprising:

a) a sound generator having a face;

b) two speakers in the general shape of animal eyes, said speakers mounted to said sound generator at two locations on said face of said sound generator;

c) an actuation switch associated with said sound generator; and d) a power supply adapted to provide electrical power to said sound generator, wherein said speakers rotate in the face of said sound generator by actuation of a corresponding switch.

3. An audio device as recited in claim 1, wherein said speakers pop-out by actuation of a switch.

4. An audio device as recited in claims 1 or 2, wherein said sound generator is selected from the group consisting of a radio, a compact disc player, a DVD player, and a cassette tape player.

5. An audio device as recited in claims 1 or 2, further comprising at least one antenna secured to said sound generator.

6. An audio device as recited in claim 1, wherein said speakers rotate in the face of said sound generator.

7. An audio device as recited in claim 2, wherein said speakers pop-out on a spring mount from said sound generator.

* * * * *